United States Patent [19]

Sloan

[11] Patent Number: 4,886,576

[45] Date of Patent: Dec. 12, 1989

[54] METHOD AND APPARATUS FOR PRODUCING UNIFORM PULP YIELDS BY CONTROLLING THE OPERATION OF A REFINER

[75] Inventor: Tod H. Sloan, Battle Ground, Wash.

[73] Assignee: Boise Cascade Corporation, Boise, Id.

[21] Appl. No.: 134,209

[22] Filed: Dec. 16, 1987

[51] Int. Cl.[4] ..... D21B 1/14; D21C 7/12; D21D 1/30

[52] U.S. Cl. ..... 162/49; 73/63; 162/61; 162/253; 162/254; 241/28; 241/33; 241/35; 241/36

[58] Field of Search ..... 162/49, 28, 254, 238, 162/263, 198, 252, 253; 241/36, 33, 35, 28; 73/63

[56] References Cited

U.S. PATENT DOCUMENTS

| | | | |
|---|---|---|---|
| 3,498,719 | 3/1970 | Wing et al. | 356/36 |
| 3,518,003 | 6/1970 | Meyn | 356/116 |
| 3,962,029 | 6/1976 | Wettermark et al. | 162/49 |
| 3,962,581 | 6/1976 | Zimmerman | 250/341 |
| 3,968,006 | 7/1976 | Zimmerman | 162/198 |
| 3,980,517 | 9/1976 | MacTaggart | 162/49 |
| 3,994,602 | 11/1976 | Howarth | 356/208 |
| 4,040,743 | 8/1977 | Villaume et al. | 356/73 |
| 4,066,492 | 1/1978 | Hill | 162/49 |
| 4,171,916 | 10/1979 | Simms et al. | 356/366 |
| 4,276,119 | 6/1981 | Karnis et al. | 162/49 |
| 4,294,653 | 10/1981 | Lindahl et al. | 162/25 |
| 4,318,180 | 3/1982 | Lundquist et al. | 364/555 |
| 4,347,101 | 8/1982 | Villavicencio | 162/25 |
| 4,402,604 | 9/1983 | Nash | 356/237 |
| 4,441,960 | 4/1984 | Karnis et al. | 162/49 |
| 4,507,556 | 3/1985 | Brenholdt | 250/341 |
| 4,514,257 | 4/1985 | Karlsson et al. | 162/49 |
| 4,598,201 | 7/1986 | Fertig et al. | 250/343 |
| 4,607,955 | 8/1986 | Corbett | 356/342 |
| 4,626,318 | 12/1986 | Prough et al. | 162/49 |
| 4,648,712 | 3/1987 | Brenholdt | 356/73 |
| 4,718,979 | 1/1988 | Tikka et al. | 162/49 |

FOREIGN PATENT DOCUMENTS 381720 8/1973 U.S.S.R. .

OTHER PUBLICATIONS

"Determination of Dangerous Shives", E. Johnsson, H. Höglund and G. Tistad, Proceedings of the International Mechanical Pulping Conference, 1973, Jun. 18–21, 1973, pp. 1–23.

"Short Wavelength Ultraviolet Absorption of Various Lignins and Related Substances [I], A Preliminary Basic Study", T. N. Kleinest & C. S. Joyce, Pulp & Paper Mag. of Canada, Apr. 1, 1957, pp. 154–158.

"Short Wavelength Ultraviolet Absorption of Various Lignins and Related Subtance [II] Lignin Determination in Sulphite Pulping Liquors", by C. S. Joyce and T. N. Kleinest, Pulp & Paper Magazine of Canada, May, 1957, pp. 131–134.

"DRT Eur-Control In-Line Refining Analyzer," by Eur-Control USA, Inc. (undated).

Du Pont 400 Photometric Analyzers, Bulletin E65640 (undated).

*Primary Examiner*—Steve Alvo

*Attorney, Agent, or Firm*—Laubscher, Preston & Laubscher

[57] ABSTRACT

A method and apparatus for producing uniform pulp yields, wherein at least a refiner is controlled in accordance with the UV absorbance of the lignin dissolved in the digester cooking liquor, thereby to produce for a given quantity of wood chips a uniform pulp yield. A backflow control valve is automatically adjusted to maintain uniform flow of a sample of the digester cooking liquor through a UV analyzer, and a flushing arrangement is provided for flushing out contaminates such as sulphur dioxide from the system. Preferably the refiner is of the two-stage type, the first stage being automatically adjusted as a function of the UV absorbance of the digester cooking liquor, and the second stage being automatically adjusted as a function of the freeness of the output fiber slurry. Also, one or more of the cooking parameters is controlled by the UV analyzer to control the fiber yield.

16 Claims, 10 Drawing Sheets

(CHIPS)
2
4
6
16
UV ANALYZER
UV (SETPOINT SIGNAL)
20a
20b
22a
22b
(PULP)
6
BLOW TANK
DIGESTER TEMPERATURE CONTROL MEANS
18a
DIGESTER TIME CONTROL MEANS
18b
8
8a
10
10a
PRIMARY REFINERS
SECONDARY REFINERS
12
12a
14
14a
26a
26b
24
FREENESS TESTER

STEPWISE REGRESSION

SELECTION: FORWARD CONTROL: AUTOMATIC

F-TO-ENTER = 3.0 MAX STEPS = 50 F-TO-REMOVE = 2.0

STEP 2

R-SQUARED = 0.653768

R-SQUARED (ADJ.) = 0.600502 MSE = 23.6543 WITH 13 D.F.

VARIABLES CURRENTLY IN MODEL

| VARIABLE | COEFF. | F-REMOVE |
|---|---|---|
| 2. SIDE | -1.36525 | 20.2392 |
| 5. FINAL MINUS FILL | -.59061 | 3.8676 |

VARIABLES CURRENTLY NOT IN MODEL

| VARIABLE | PARTIAL CORR. | F-ENTER |
|---|---|---|
| 1. FILL | .0555 | .0371 |
| 3. REDUCT | .0490 | .0288 |
| 4. FINAL | .0555 | .0371 |

MODEL FITTING RESULTS

| VARIABLE | COEFFICIENT | STND. ERROR | T-VALUE | PROB( )ITI) |
|---|---|---|---|---|
| CONSTANT | 124.225601 | 15.828901 | 7.8480 | .0000 |
| SIDE | -1.365245 | 0.303469 | -4.4988 | .0006 |
| FINAL MINUS FILL | -0.59061 | 0.300308 | -1.9667 | .0709 |

4 CASES WITH MISSING VALUES WERE EXCLUDED.

FIG. 10A

FIG. 10B

SPECIFIC ENERGY-LIQUOR ABSORBANCE DATA

| DAY | PRIMARY MWATT | PRIMARY UNIFLOW | SECONDARY EAST MWATT | SECONDARY EAST UNIFLOW | SECONDARY WEST MWATT | SECONDARY WEST UNIFLOW | PRIMARY SPE | SECONDARY SPE | DECKER HPD/T | Cook CSF | UV ABSORBANCE Num | FILL | SIDE | REDUC | FINAL |
|---|---|---|---|---|---|---|---|---|---|---|---|---|---|---|---|
| 6-9 | 3.4 | 21 | 3.4 | 18 | 2.4 | 18 | 24.0 | 38.4 | 62.4 | 604 | 3-60 | 29 | 33 | 59 | 67 |
| 6-10 | 2.9 | 16.2 | 2.5 | 21 | 2.5 | 21 | 26.0 | 41.5 | 67.5 | 675 | 3-63 | 28 | 30 | 55 | 64 |
| " | 3.1 | 18 | 2.4 | 42 | 2.5 | 24 | 25.2 | 39.5 | 64.8 | 549 | 3-66 | 26 | 29 | 62 | 62 |
| 6-11 | 2.7 | 24 | 2.8 | 19 | 2.8 | 19 | 16.8 | 33.0 | 49.8 | | 3-69 | 28 | 28 | | 75 |
| " | 3.1 | 19 | 2.7 | 20 | 2.7 | 20 | 24.0 | 39.1 | 63.1 | | 3-72 | 22 | 22 | | 58 |
| " | 2.4 | 21 | 2.4 | 24 | 2.6 | 24 | 16.9 | 33.1 | 50.1 | | 3-75 | 28 | 31 | 68 | 77 |
| 6-13 | 3.3 | 22 | 2.5 | 18 | 2.4 | 18 | 22.3 | 31.2 | 53.5 | | 3-87 | 32 | 32 | 62 | 73 |
| 6-24 | 2.8 | 18 | 2.7 | 22 | 2.6 | 22 | 22.8 | 40.2 | 63.0 | 627 | 3-93 | 29 | 31 | 56 | 67 |
| " | 3.2 | 22.5 | 3.2 | 18 | 2.8 | 18 | 21.2 | 37.4 | 58.6 | | 3-96 | 28 | 34 | 60 | 72 |
| 6-15 | 3 | 19 | 2.5 | 21 | 2.5 | 21 | 23.2 | 36.2 | 59.4 | | 3-99 | 24 | 26 | 62 | 64 |
| " | 3.1 | 23 | 2.7 | 24 | 2.7 | 24 | 20.1 | 33.0 | 53.1 | | 3-102 | 24 | 31 | | 54 |
| " | 2.9 | 19 | 2.6 | 20 | 2.6 | 20 | 22.5 | 37.6 | 60.1 | | 3-105 | 26 | 30 | | 49 |
| 7-8 | 2.15 | 15 | 1.8 | 18 | 1.6 | 18 | 20.7 | 30.1 | 50.8 | 579 | 2-42 | 30 | 32 | 70 | 79 |
| 7-11 | 3.1 | 20 | 1.9 | 17.4 | 1.9 | 17.4 | 22.9 | 26.3 | 49.2 | 484 | 2-57 | 30 | 34 | 60 | 70 |
| " | 2 | 20 | 2.4 | 24 | 2.4 | 24 | 14.8 | 33.2 | 48.0 | 577 | 2-60 | 32 | 37 | 63 | 72 |
| 7-12 | 2.2 | 16.2 | 1.8 | 16.2 | 1.7 | 16.2 | 19.7 | 29.0 | 48.8 | 645 | 2-63 | 33 | 38 | 60 | 70 |
| " | 2.7 | 15.6 | | | 3 | 24 | 25.1 | 13.9 | 39.0 | 534 | 2-66 | 34 | 41 | 60 | 72 |
| 7-13 | 2.5 | 21 | 2.4 | 15.6 | 2.4 | 15.6 | 17.6 | 31.8 | 49.5 | 509 | 2-73 | 37 | 40 | 78 | 83 |
| 7-14 | 2.5 | 17.4 | 1.9 | 18 | 1.8 | 18 | 21.0 | 28.9 | 49.9 | 633 | 2-76 | 36 | 38 | 65 | 75 |
| 7-17 | 3 | 21 | 2.2 | 21 | 2.2 | 21 | 21.2 | 29.2 | 50.3 | 671 | 2-94 | 32 | 34 | 67 | 74 |
| AVERAGE: | 2.8 | 19.4 | 2.5 | 20.9 | 2.4 | 20.2 | 21.4 | 33.1 | 54.5 | 591 | | 29 | 33 | 63 | 69 |
| CVZ: | 14 | 13 | 17 | 27 | 16 | 13 | 14 | 19 | 13 | 10 | | 13 | 14 | 9 | 12 |
| MIN: | 2 | 15 | 1.8 | 15.6 | 1.6 | 15.6 | 14.8 | 13.9 | 39.0 | 484 | | 22 | 22 | 55 | 49 |
| MAX: | 3.4 | 24 | 3.4 | 42 | 3 | 24 | 26.0 | 41.5 | 67.5 | 675 | | 37 | 41 | 78 | 83 |

METHOD AND APPARATUS FOR PRODUCING UNIFORM PULP YIELDS BY CONTROLLING THE OPERATION OF A REFINER

STATEMENT OF THE INVENTION

This invention relates to a method and apparatus for achieving uniform pulp yields from given quantities of wood chips, characterized by the control of at least the refining stage as a function of the measurement of the UV absorbance of the lignin dissolved in the cooking liquor of the digesting stage.

BRIEF DESCRIPTION OF THE PRIOR ART

It is known in the patented prior art relating to papermaking processes and apparatus to measure various physical properties of the fiber output—such as consistency, brightness, chemical composition, fiber length distribution, or surface area—for controlling brightness, consistency, refining energy or the like. In the Lundquist et Pat. No. 4,318,180, an optically-measured property of the pulp slurry (such as the size distribution of particles flowing in a stream) is measured for automatically adjusting the beating disks of the refining stage. In the patent to Karnis et al, a control valve is automatically controlled by optically responsive means to maintain constant the consistency of the stock, The automatic control of the supply of chemicals to a pulp slurry is disclosed in the patents to Wettermark et al No. 3,962,029, Zimmerman No. 3,968,006 and MacTaggart No. 3,980,517, and the use of UV light in measuring the fines in pulp suspensions is shown by the patent to Karlsson et al No. 4,514,257. The patent to Nash et al No. 4,402,604 relates to the on-line measurement of dirt particles, and the Hill Pat. No. 4,066,492 relates to the on-line measurement of shives.

It is also known in the prior literature to measure various lignins and related substances by means of ultraviolet energy absorption. "Short Wavelength Ultraviolet Absorption of Various Lignin and Related Substances, I. A Preliminary Basic Study" by T. N. Kleinert and C. S. Joyce, Pulp and Paper Magazine of Canada, April, 1957, pages 154–158; and "Short Wavelength Ultraviolet Absortion of Various Lignins and Related Substances, II, Lignin Determination in Sulphite Pulping Liquors", by C. S. Joyce and T. N. Kleinert, Pulp and Paper Magazine of Canada, May, 1957, pages 131–134.

The present invention was developed to provide an improved digesting and refining system for paper-making machines, wherein the pulp yield from a given quantity of wood chips meets close standards of uniformity in order to produce paper of optimum strength characteristics.

OBJECTS OF THE INVENTION

Accordingly, a primer object of the present invention is to provide an improved papermaking system and method wherein the operation of at least the refiner is controlled as a function of the UV absorbance of the lignin dissolved in the cooking liquor of the digester.

According to a more specific object of the invention, both the refiner and the digester are controlled by UV analyzer means as a function of the UV absorbance of the lignin dissolved in the cooking liquor of the digester. In this case, a parameter of the cooking cycle—such as temperature or length of cooking time—as well as the operation of the refiner stage, are automatically controlled by control signals supplied by the UV analyzer. Automatically adjustable back pressure control valve means are provided for automatically controlling the flow through the UV analyzer in order to obtain the most accurate absorbance readings possible. Furthermore, flushing means are provided for flushing contaminates such as bubbles of sulphur dioxide from the UV analyzer and the filter means associated therewith.

According to another object of the invention, the refiner includes two series connected stages, the first stage being controlled as a function of the UV abosrbance of the cooking liquor of the digester, and the second stage being controlled as a feedback function of the freeness of the fiber output of the second refiner stage.

BRIEF DESCRIPTION OF THE DRAWINGS

Other objects and advantages of the invention will become apparent from a study of the following specification, when viewed in conjunction with the accompanying drawings, in which:

FIGS. 10A and 10B form a table illustrating the results of a number of cooks using the present invention.

DETAILED DESCRIPTION

Figure 1:
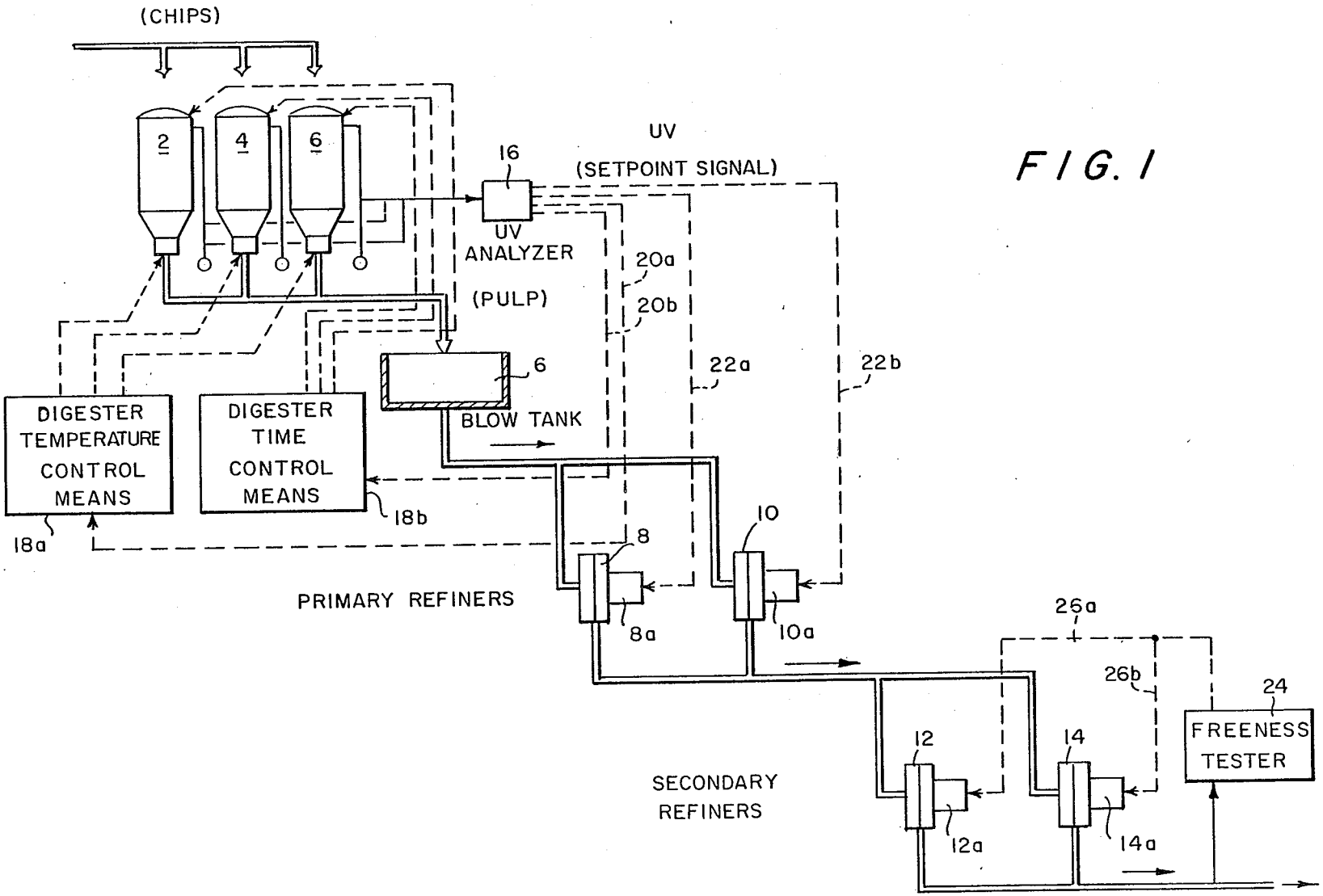
FIG. 1 is a block diagram of the chip processing system of the present invention including two-stage refining.

Referring first more particularly to FIG. 1, wood chips formed from woods such as black spruce, jack pine, balsam fir, and the like, are introduced into three digesters 2, 4 and 6 for cooking by a conventional commercial sulfite cooking liquor (i.e., a bisulfite cooking liquor) for a given period of time (for example, about 6 hours) at a given temperature (for example, about 140° C.). The cooked chips or pulp is discharged from the digesters into a blow tank 7 from which the pulp is introduced into a pair of parallel-connected primary refiners that define the first stage of a two-stage refining system. The wood fibers and pulp discharged from the primary refiners are supplied to a second refining stage comprising a pair of secondary refiners 12 and 14 connected in parallel, whereupon the resultant wood fibers are supplied to the remaining portion of a conventional papermaking machine.

The refiners 8, 10, 12 and 14 are each of the electromechanical type including a pair of relatively rotatable and axially displaceable circular plates or disks between which the cooked wood chips are pulverized into long fiber and short fiber wood pulp. The axial spacing distance between the disks is controlled as a function of the magnitude of an electrical control signal applid thereto, as is known in the art. An example of such a refiner is the Sprout-Waldron 45-1B refiner.

In accordance with a characterizing feature of the present invention, samples of the cooking liquor at selected times of the cooking cycle of each batch are supplied to an ultraviolet energy analyzer 14 which is operable to measure the UV absorbance of the lignin that is removed during the cooking of the wood chips and is dissolved in the cooking liquor. An example of such an UV analyzer is the DuPont 400 Photometric Analyzer manufactured by DuPont Company Instrument Systems. As a consequence of the amount of lignin dissolved in the liquor—which in turn is based on the initial quantity of wood chips, the cooking temperature, the length of the cooking time, and other similar parameters—as determined by the UV absorbance characteristic of the cooking liquor, corresponding electrical control signals are transmitted to the digester temperature and length of time cook control means 18*a* and 18*b* via conductors 20*a* and 20*b*, respectively, and to the disk spacing distance control means 8*a* and 10*a* of primary refiners 8 and 10 via conductors 22*a* and 22*b*, respectively. The second stage refiners 12 and 14 are similarly controlled by electrical signals supplied from freeness tester 24 via conductors 26*a* and 26*b* in accordance with the measured freeness of the pulp slurry output of the second refiner stage. An example of such a known freeness tester is the DRT Eur-Control In-Line Refining Analyzer, manufactured by Eur-Control Kalle AB of Saffle, Sweden.

Figure 2:
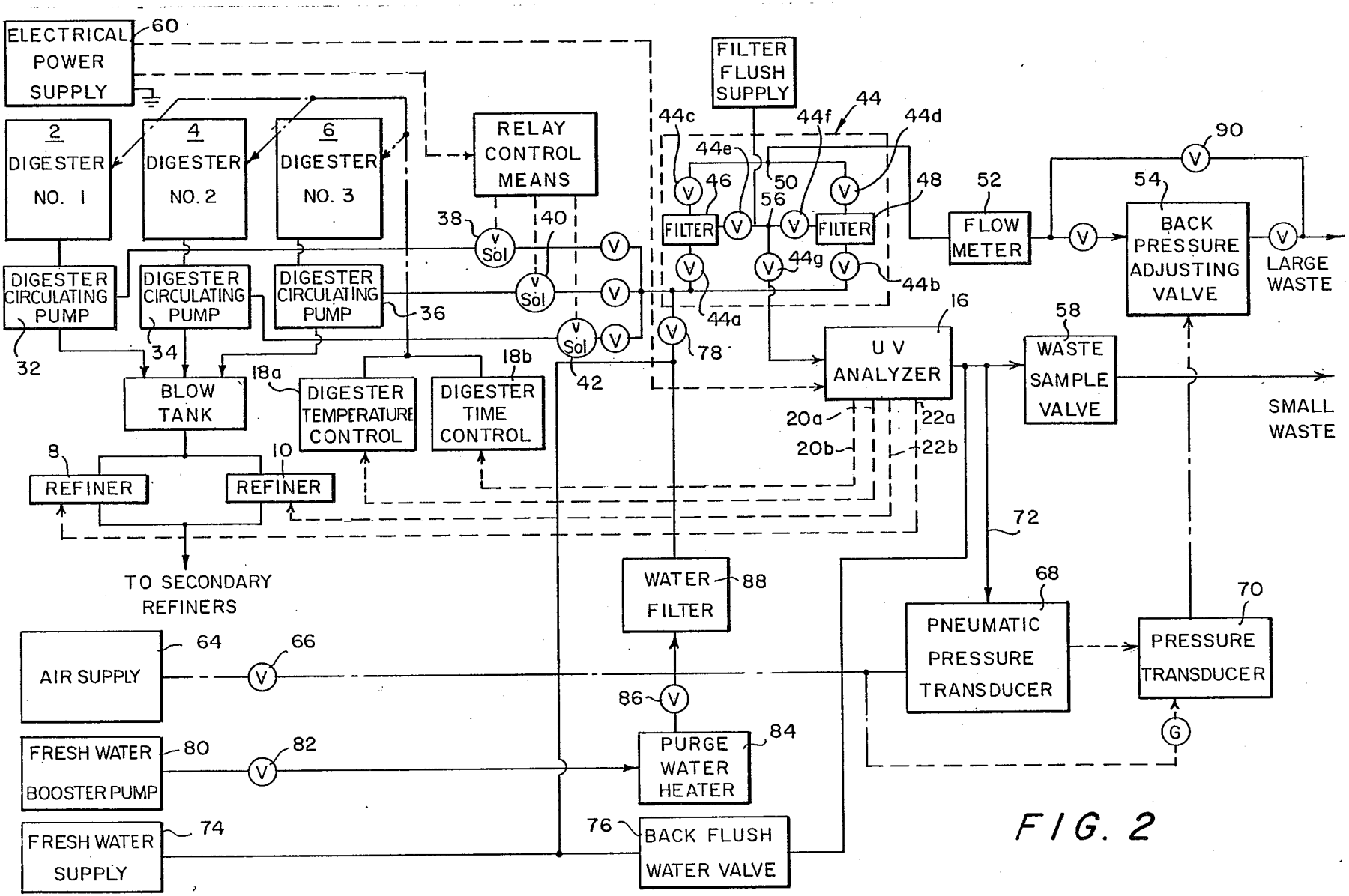
FIG. 2 is a detailed block diagram of the hydraulic, pneumatic and electrical circuitry associated with the UV analyzer portion of the system of FIG. 1.

Referring now to FIG. 2, the cooking liquor samples are supplied to the UV analyzer 16 from the circulating pumps 32, 34 and 36 associated with the digesters 2, 4 and 6, respectively, via relay-operated solenoid valves 38, 40 and 42, respectively, and filter means 44. More particularly, the filter means includes an inlet 45, and a pair of filters 46 and 48 connected in parallel to define a output 50 that is connected with waste via flow meter 52 and back pressure adjusting valve 54. A central cross connection between the filters includes another output 56 connected with the fluid input of the UV analyzer, which analyzer has an output connected with waste via waste sample valve 58. Electrical control signals that correspond with the measured UV absorbance characteristic of the lignin dissolved in the cooking liquor are supplied to the digester temperature and cooking length time controls 18*a* and 18*b* via conductors 20*a* and 20*b*, respectively, and to the disk spacing controls of primary refiners 8 and 10 via conductors 22*a* and 22*b*, respectively. Electrical power is supplied to the relay control means and to the UV analyzer from power supply 60.

In accordance with an important feature of the invention, a uniform flow of the cooking liquor through the filter means and through the UV analyzer is achieved by the regulation of the back pressure adjusting valve 54 as a function of the outlet pressure of the UV analyzer. More particularly, pressure air from the air source 64 is supplied to the control chamber of the diaphragm-operated back pressure adjusting valve 54 via manually-operable valve 66, pneumatic pressure transducer 68, and pressure transmitter 70. The pneumatic pressure transducer is operable to regulate the air pressure supplied from source 64 as a function of the outlet pressure of the UV analyzer 16, as sensed by fluid supplied via conduit 72. Thus, if the outlet pressure of the UV analyzer should drop below a given value, the pressure drop is transmitted to pressure transducer 68 via conduit 72, and the air pressure supplied to the back pressure valve 54 via pressure transducer 68 and pressure transmitter 70 causes a corresponding partial closing of the back pressure valve, thereby to cause the output pressure of the UV analyzer to be returned to the desired value. Thus, the pressure regulator 68 insures that a constant liquor flow is maintained on the liquor bypass line by adjusting the back pressure valve 54 by means of the pressure transmitter 70.

In accordance with another important feature of the invention, means are provided for back flushing the various components of the system to remove the contaminates therefrom. Fresh water supply 74 is connected with the output of UV analyzer 16 via back flush water valve 76, and with the inlet of the filter circuit via shut off valve 78. Similarly, fresh water booster pump 80 is connected with the filter input via valve 82, purge water heater 84, valve 86, water filter 88, and shut off valve 78. Thus, to flush out the filter means 44, valves 44*e*, 44*f*, 44*g*, 38, 40 and 42, are closed, and valves 78, 44*a*, 44*b*, 44*c* and 44*d* are opened, whereupon water from supply 74 is supplied to waste via valve 78, filter means 44, flow meter 52, and back pressure adjusting valve 54. Upon closing of waste sample valve 58 and opening of valves 44*e*, 44*f* and 44*g*, back flush water will flow through UV analyzer 16 in the reverse direction, and thence to waste via flow meter 52 and back pressure adjusting valve. If desired, by pass valve 90 may be opened to feed the back flush water to waste. As a consequence of the flushing of the various lines of the system, all undesirable $SO_2$ bubbles and other contaminates are displaced from the system.

Operation

In operation, the amount of dissolved lignin in the cooking liquor, as measured by its UV absorbance, corresponds with the appropriate amount of energy for producing the strongest pulp. Thus, the measurement of the UV absorbance occurs at various times during the cooking phase of the process while the pulp is still in chip form. Owing to the strong relationship between the UV absorbance of the cooking liquor and the amount of specific energy required by the first stage refiners 8 and 10, the present invention offers the advantage of better control over the refining operation by avoiding conditions of "over" and "under" refining, since the refining power is adjusted before the pulp is processed. Improved control results in desirable narrow limits of uniformity in the resultant pulp, thereby causing better pulp strength to be achieved. The operation of the first stage refiners is controlled as a function of the signals supplied from the UV analyzer via conductors 20*a* and 20*b*, which signals are a function of the UV absorbance of the lignin in the cooking liquor. In the illustrated batch type system, the lignin absorbance measurement is taken near the end of the cooking cycle. In a continuous type system, the lignin UV absorbance is measured at various locations along the vessel corresponding to different times during the cooking cycle. In the case of the supply of control signals from the UV analyzer to the digester temperature and time control means 18*a* and 18*b* via conductors 22*a* and 22*b*, respectively, these lignin UV absorbance measurements are taken at various times during the cooking cycle, whereby the various cooking parameters—such a temperature, length of cook, quantity of cooking chemicals, or the like—are appropriately varied during the cooking cycle.

Figure 3:
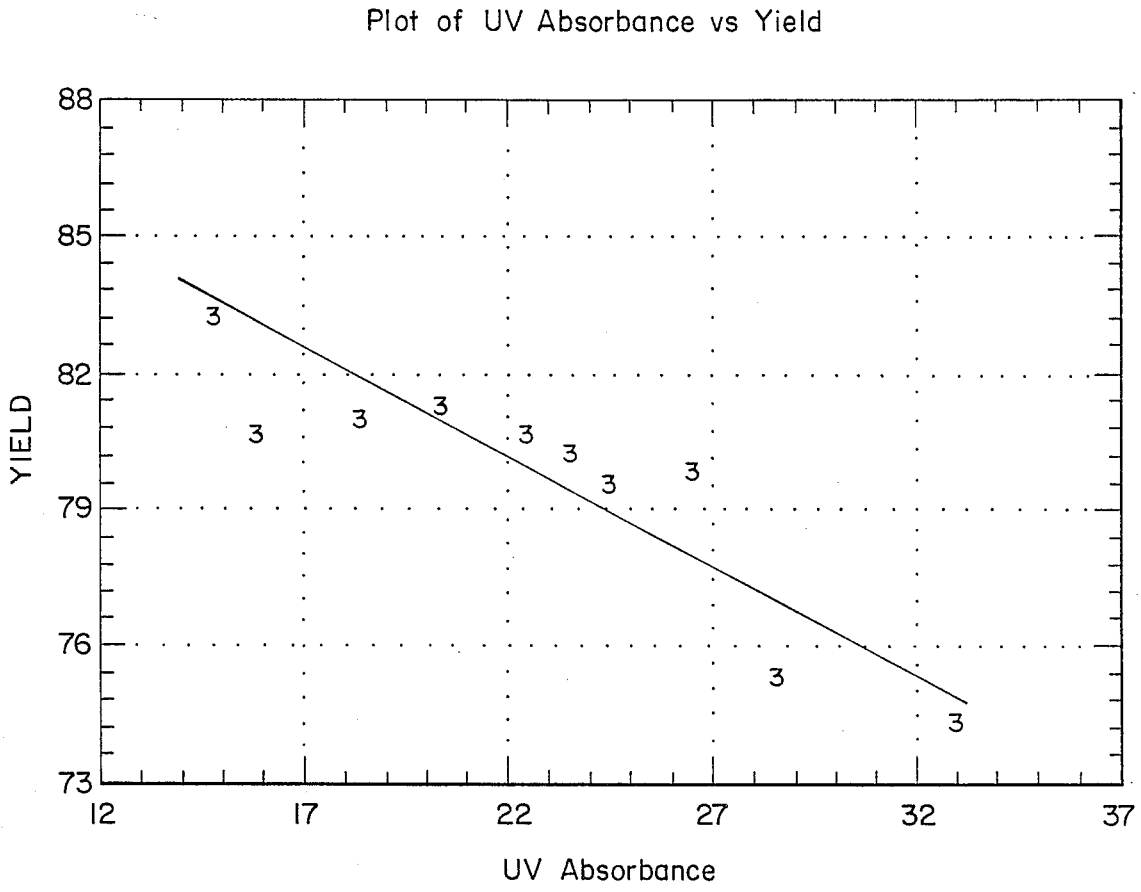
FIG. 3 is a graph illustrating the relationship between UV absorbance and pulp yield for a given quantity of wood chips.

Referring now to FIG. 3, the process for controlling yield involves the measurement by the UV analyzer of the amount of lignin dissolved in the cooking liquor as a function of its UV absorbance. The dissolved wood component in the cooking liquor at the end of the cook corresponds to the loss in original wood weight which is equal by difference to the pulp yield. The pulp yield—which is defined as being the ratio of the weight of the pulp to the initial weight of the wood, expressed as a percent—is controlled by monitoring the cooking liquor during the digestion process. The UV absorbance is inversely proportional to the pulp yield (which largely dictates the refining power required to achieve the desired pulp freeness). At a predetermined UV signal level, the cook is stopped to obtain the desired yield. The system of the present invention is applicable to any pulping system where yield control is important, such as batch or continuous digesters, kraft, sulfite or chemimechanical processes. One advantage resulting from the present invention is that a more uniform (less variable) higher strength pulp is produced. Furthermore, the invention lends itself to use with a fully automated digesting and refining system.

Figure 4:
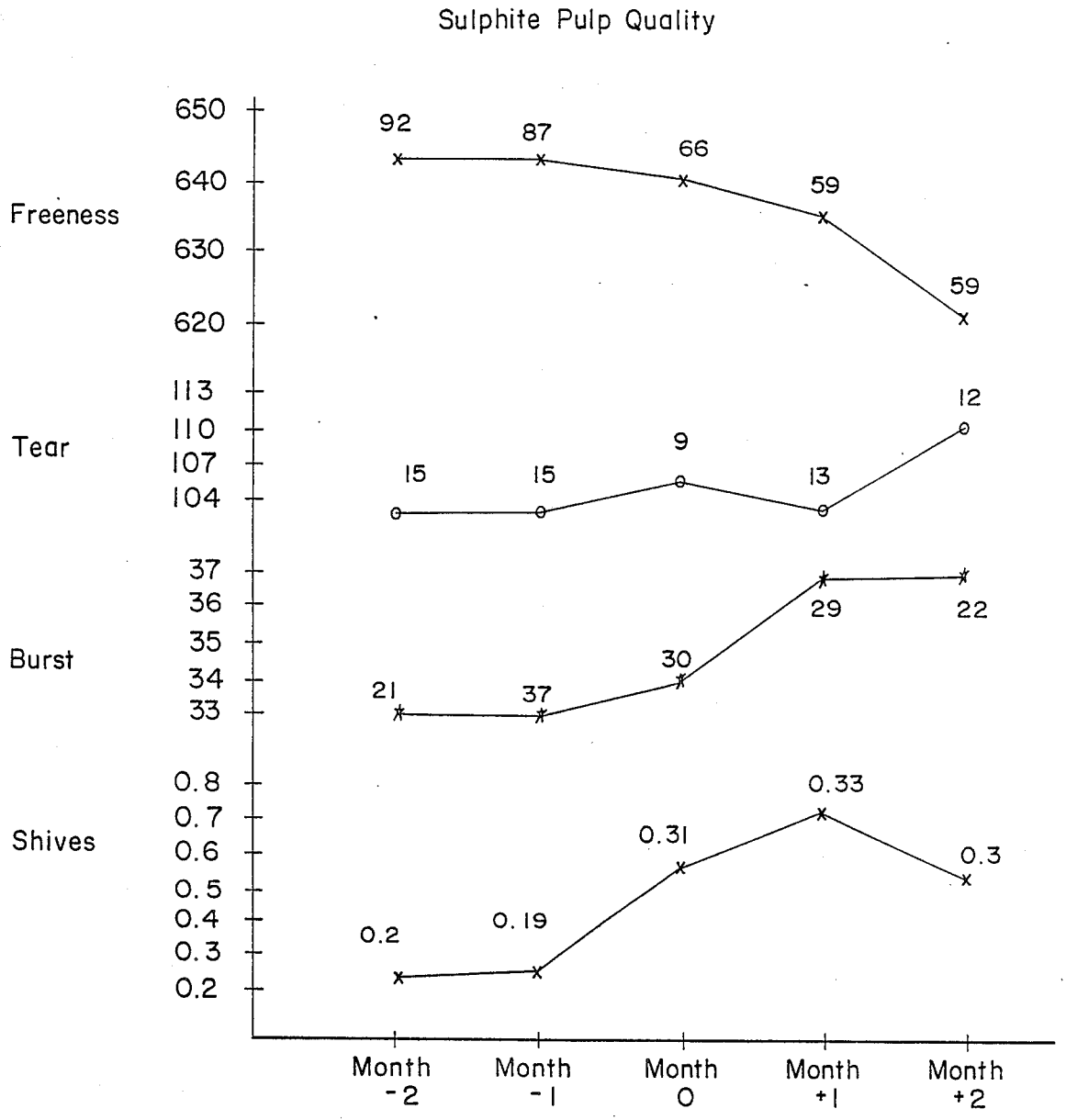
FIG. 4 is a graph illustrating certain sulphite pulp quality curves for successive one-month periods before and after the installation of the UV analyzer uniform pulp yield system of the present invention.

FIG. 4 illustrates the parameters of freeness, tear, burst and shives in pulp yields produced for each of the two one-month periods before and after the installation of the improved yield control system of the present invention. It will be noted that the tear and burst strength of the resulting paper product increased following installation, and the freeness of the pulp was lowered from 87 to 66.

Figure 5:
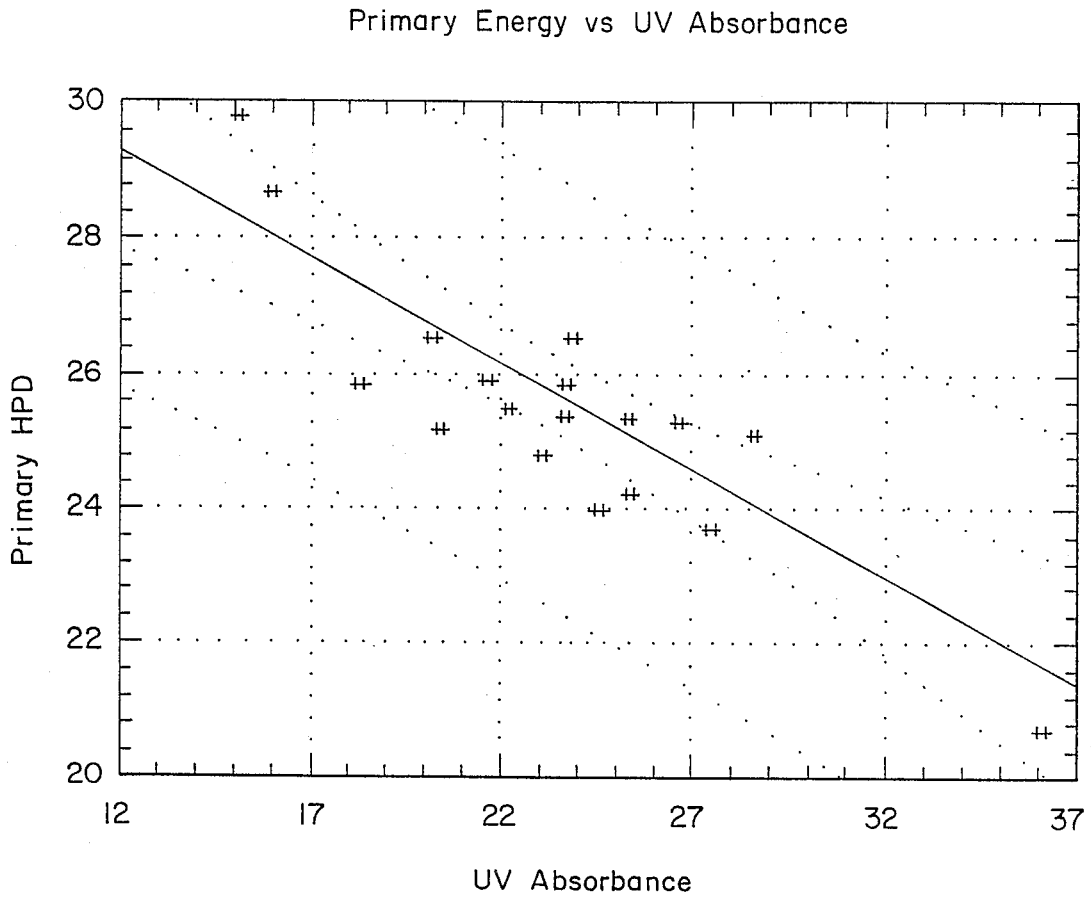
FIG 5 is a graph illustrating primary refiner energy plotted against UV absorbance.

Referring now to FIG. 5, a primary advantage of the present invention is that the control is able to "look ahead" so that the appropriate refiner conditions are set up before any refining takes place, whereby owing to the uniformity of the pulp produced, close to the ultimate strength potential of the fibers is achieved. Furthermore, there is no time delay associated with the UV absorbance signal, and hence there is no waiting for pulp test results before adjustments can be made on the fir refining stage. Once the UV absorbance signal is measured at the end of a batch digester cycle, it can be immediately employed to set the refiner, as shown in FIG. 5. This is of particular importance in the case of continuous digesting operation, since the yield will gradually shift from time to time, requiring different refining demand (i.e., adjustment of the operation of the refiners for processing of the pulp slurry). As will be described below, the points on FIG. 5 correspond with data taken from the table of FIGS. 10A and 10B.

Figure 6:
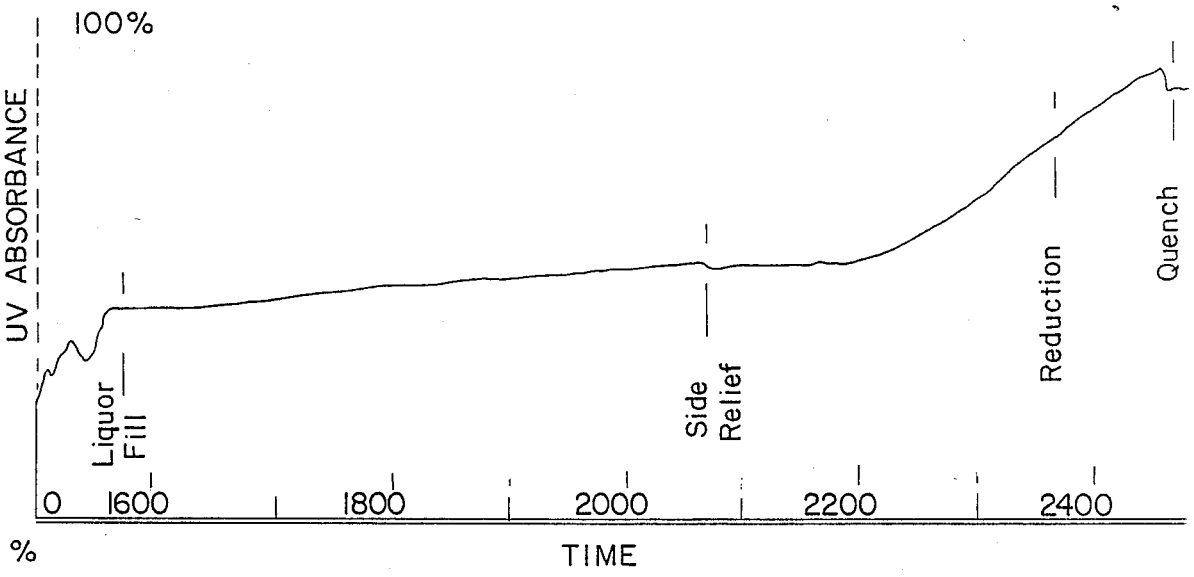
FIG. 6 is a graph illustrating the UV absorbance of the cooking liquor for a complete cooking cycle.

FIG. 6 illustrates the UV absorbance of the cooking liquor over a typical approximately eight hour cooking cycle. The UV absorbance shows an initial positive reading which gradually increases throughout the cook. In this cook, there was relatively little increase in UV absorbance during the five hour period between liquor fill and side relief (since only a minor amount of delignification occurred). After side relief, there was a marked increase in absorbance up to reduction, corresponding to the maximum rate of delignification. After reduction, the delignification continues at a lower rate as the cooking liquor begins to cool. The final absorbance is proportional to the total amount of lignin removed.

Figure 7:
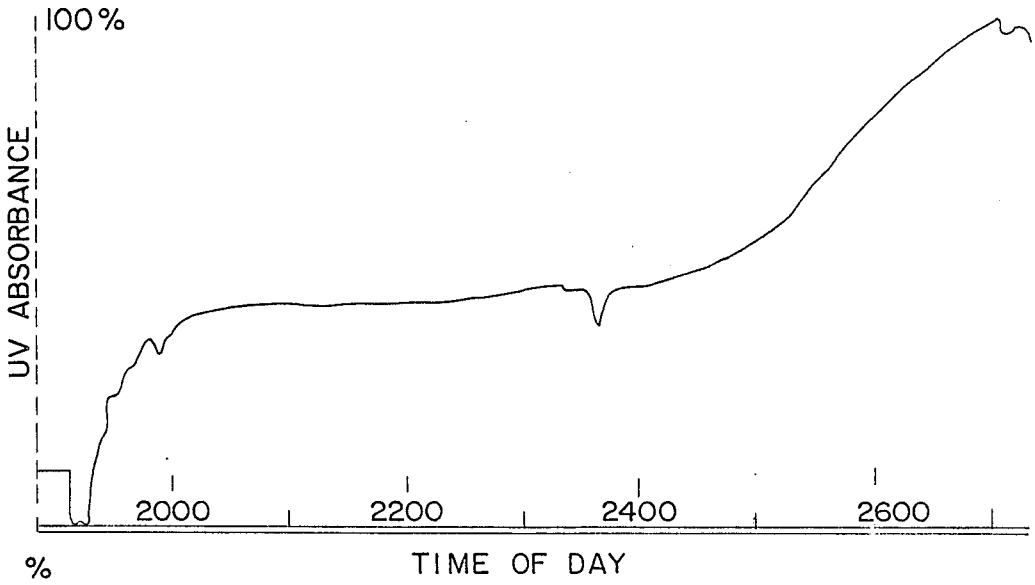
FIGS. 7 and 8 are curves illustrating the UV absorbance of cooking liquor conditions requiring low and high specific refining energies, respectively.
Figure 8:
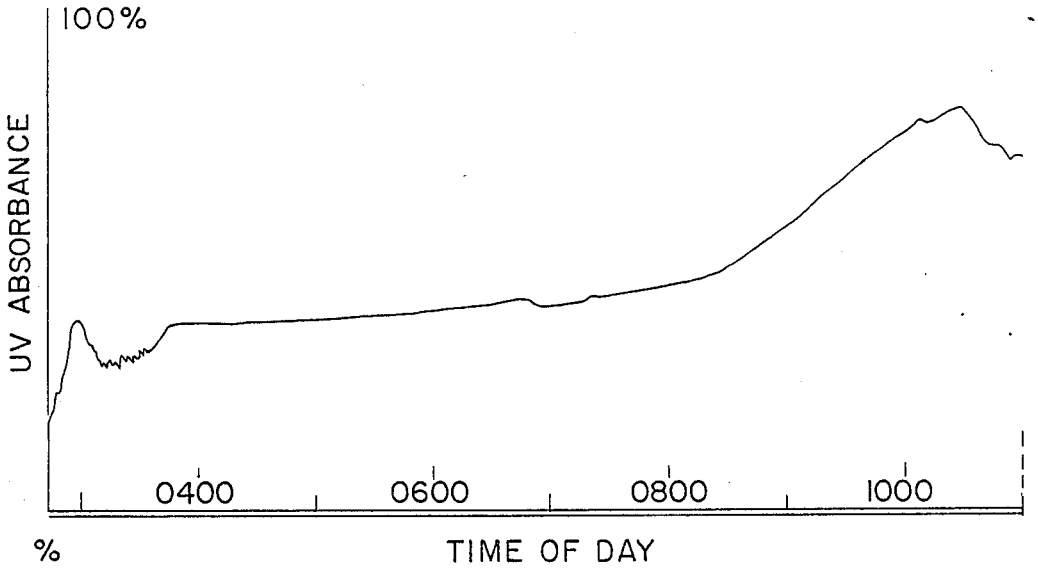

FIGS. 7 and 8 illustrate examples of high absorbance low yield (i.e., 75% yield) and low absorbance high yield (i.e., 85% yield), respectively. As shown in FIG. 5, the refining energy is inversely proportional to the yield, and consequently, more first stage refining energy is called for in the second case than in the first case.

Figure 9:
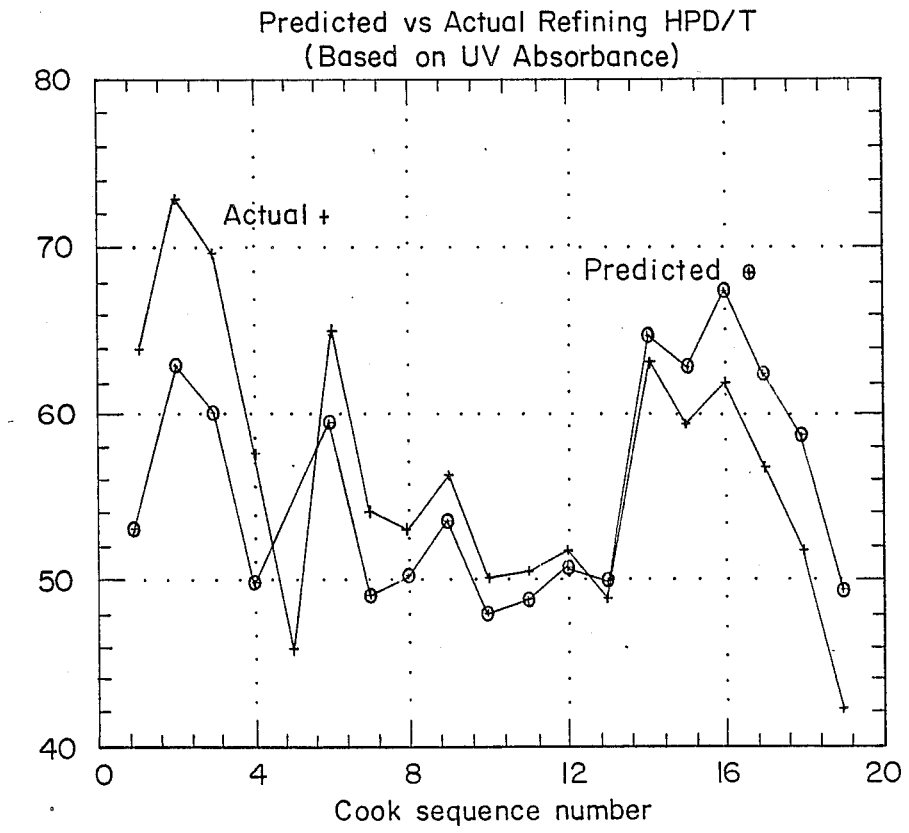
FIG. 9 is a graph illustrating the predicted versus the actual refining energies for an number of experimental cooking sequences.

Referring now to FIGS. 9, 10A and 10B, the graph of FIG. 9 illustrates predicted and actual results of a number of tests based on the following formula derived form the table of FIGS. 10A and 10B (which presents UV absorbance data collected as a result of a number of tests):

$$HPD/\text{ton} = 124 - 1.36 \times (\text{side absorp.}) - .59 \times (\text{final} - \text{fill})$$

The diagonal lines defined by the rows of dots in FIG. 5 are measures of the statistical certainty of the solid line which is a plot of the above equation. The data points in FIG. 5 are actual values taken from FIG. 10B. In FIG. 10, the UV absorbance for fill, side, reduction and endpoint of cooks are shown on the right side of the table, associated refining data are shown on the left, and the specific energy is shown in the middle column. The refiner energy was determined statistically by a "least squares fit" of the data in FIG. 10B. In practice, target absorbance will be sought for a given cook (by adjusting cooking time). The specific energy demand for that absorbance is defined by a point on the solid line in FIG. 5.

During use of the present invention in a given prototype system, the pulp per blow was increased from 27 BDST to 35.5 BDST, the blows per day were increased from 6.7 to 8.0, and the digester cylce time was reduced from 10.8 to 9.12 hours.

The use of the UV analyzer for measuring the amount of lignin dissolved in the digester cooking liquor permits the pulp yield to be controlled—for example, by the addition of cooking liquor—so that an optimum yield, such as 80%, for example, is obtained. In the past, it was only possible to determine the pulp yield after the pulp had left the digester. Moreover, by programming the refiner for operation on this 80% yield, there is a conservation of refiner energy, and a better, stronger paper product is produced. Since the fibers produced from a given quantity of wood chips have a given degree of uniformity, they are kept in a freer state at the 80% level.

What is claimed is:

1. Apparatus for producing a uniform pulp yield from a given quantity of wood chips, comprising:

(a) digester means for cooking the wood chips in a cooking liquor to produce cooked wood chips from which the lignin has been at least partially removed and dissolved in the cooking liquor;

(b) refiner means for refining the cooked wood chips to produce wood pulp fibers therefrom;

(c) UV analyzer means for measuring the UV absorbance of the lignin dissolved in the cooking liquor; and (d) control means responsive to said UV analyzer means for controlling the operation of at least the refiner means as a function of the UV absorbance of the lignin dissolved in said cooking liquor, thereby to cause the pulp fibers to meet a given standard of uniformity.

2. Apparatus as defined in claim 1, wherein said refiner means includes means operable by said control means for varying the refining energy produced by said refiner means.

3. Apparatus as defined in claim 2, wherein said digester means includes means operable by said control means for varying the length of the cooking time of said wood chips in said digester means.

4. Apparatus as defined in claim 2, wherein said digester means includes means operable by said control means for varying the cooking temperature of said wood chips in said digester means.

5. Apparatus as defined in claim 4, wherein said refiner means includes a pair of rotatable coaxially arranged relatively axially displaceable pulverizing disks, said control means being operable to relatively axially displace said pulverizing disks to vary the spacing therebetween.

6. Apparatus as defined in claim 5, wherein said refiner means comprises first and second stage refiners connected in series, said first and second stage refiners each including said relatively rotatable and axially displaceable disks.

7. Apparatus as defined in claim 6, and further including means (24) for measuring the freeness of the pulp yield from said second stage refiners, and means (12*a*, 14*a*) responsive to said freeness measuring means for varying the spacing distance of said second stage refiner disks as a function of the freeness of the pulp fibers discharged from said second stage refiner means.

8. Apparatus as defined in claim 5, wherein said digester means includes circulating pumps means, and means for supplying samples of said cooking liquor from said circulating pump means to said UV analyzer means, and differential flow control means including back pressure adjusting valve means for maintaining constant the supplied samples of said cooking liquor to said UV analyzer means.

9. Apparatus as defined in claim 8, wherein said UV analyzer means includes a fluid input and a fluid output, and further including filter means having an inlet (45) connected with said circulating pump means and a first outlet (56) connected with said UV analyzer input, said filter means having also a second outlet (50), and waste sample valve means (58) connecting the output of said UV analyzer with waste, said back pressure adjusting valve means connecting said filter second outlet with waste, and further including pneumatic means for controlling the operation of said back pressure valve means as a function of the output pressure of said UV analyzer means.

10. Apparatus as defined in claim 9, and further including means for back flushing said filter means with water to remove the contaminates therefrom.

11. Apparatus as defined in claim 10, and further including means for back flushing said UV analyzer.

12. The method of producing a uniform pulp yield from a given quantity of wood chips, comprising the steps of:

(a) cooking the wood chips in a cooking liquor in a digester to produce cooked wood chips from which the lignin has been at least partially removed and dissolved in the cooking liquor;

(b) refining the cooked wood chips in a first refiner to mechanically break down the wood chips into pulp fibers;

(c) measuring the UV absorbance of the cooking liquor to determine the amount of lignin dissolved therein; and (d) controlling the operation of the first refiner as a function of the ultraviolet energy absorbance characteristic of the liquor in which the lignin is dissolved, thereby to cause the resultant wood pulp to meet a given standard of uniformity.

13. The method as recited in claim 12, wherein the length of time of the cooking step is controlled as a function of the ultraviolet energy absorbance characteristic of the cooking liquor in which the lignin is dissolved.

14. The method as recited in claim 12, wherein the temperature of the cooking step is controlled as a function of the ultraviolet energy absorbance characteristic of the cooking liquor in which the lignin is dissolved.

15. The method as defined in claim 12, wherein the wood chips are cooked in batches in said digester, and further wherein the ultraviolet absorbance characteristic is measured repeatedly during the cooking cycle.

16. The method as defined in claim 12, and including the further steps of:

(e) refining the fibers produced by said first refiner in a second stage refiner;

(f) measuring the freeness characteristic of the fibers produced by said second stage refiner; and (g) controlling the operation of said second stage refiner as a function of the freeness characteristic of the fibers produced by said second stage refiner.

* * * * *